US009613604B1

(12) United States Patent
Shearer

(10) Patent No.: US 9,613,604 B1
(45) Date of Patent: Apr. 4, 2017

(54) MUSICAL-INSTRUMENT HUMIDIFIERS, SYSTEMS AND METHODS

(71) Applicant: Eric J. Shearer, West Jordan, UT (US)

(72) Inventor: Eric J. Shearer, West Jordan, UT (US)

( * ) Notice: Subject to any disclaimer, the term of this patent is extended or adjusted under 35 U.S.C. 154(b) by 0 days.

(21) Appl. No.: 15/018,789

(22) Filed: Feb. 8, 2016

(51) Int. Cl.
*G10G 7/00* (2006.01)

(52) U.S. Cl.
CPC ..... *G10G 7/00* (2013.01)

(58) Field of Classification Search
CPC G10D 13/00; G10D 3/00; G10D 9/00; G10D 7/00; G10G 5/00; G10G 7/005; G10G 7/00
See application file for complete search history.

(56) References Cited

U.S. PATENT DOCUMENTS

| | | | | |
|---|---|---|---|---|
| 696,152 | A | 4/1902 | Strauss | |
| 855,984 | A | 6/1907 | Russell | |
| 3,407,700 | A | 10/1968 | Hollander | |
| 3,721,152 | A | 3/1973 | Von Meyer | |
| 4,428,892 | A | 1/1984 | Berliner | |
| 4,572,051 | A | 2/1986 | Laskin | |
| 4,649,793 | A | 3/1987 | Blackshear | |
| 5,289,751 | A * | 3/1994 | Light | G10G 7/00 239/51.5 |
| 2007/0023939 | A1 * | 2/2007 | Hepple | G10G 7/00 261/104 |

OTHER PUBLICATIONS

Musicnomad: The HumiReader—Humidity & Temperature Monitor.
Paganini: Humidifier for Violin/Viola & Cello.
Taylor: Hygro-Thermometer Mini.
Stretto: Violin and Viola Humidifier with Digital Hygrometer.
Herco: Guardfather HE360 Humidifier.
Planet Waves: Small Instrument Humidifier.
Oasis: HumiGel Replacement Kit.

* cited by examiner

*Primary Examiner* — Kimberly Lockett
(74) *Attorney, Agent, or Firm* — Stephen Preston Law LLC; Stephen J. Preston

(57) ABSTRACT

Disclosures teach managing humidity within a musical instrument. For example, a fluid tank, which may be attachable to an instrument holder, may hold fluid deliverable through a conduit into a breathable housing, which may be configured for insertion within, for example, a sound box. A fluid trap may be included within the housing to collect the entering fluid. The trap may also store the fluid during evaporation, increasing humidity in the instrument. A flow regulator may be included within the channel passing through the conduit to manage the fluid flow rate. A measuring device may be included to provide measurements of humidity within the instrument. Management logic may generate, based on humidity measurements from the measurement device, adjustment signals, adjusting the flow regulator to change the flow rate to impact humidity. A detector, indicating overflow from the fluid trap, and/or an overflow structure, capturing overflow, may also be provided.

20 Claims, 7 Drawing Sheets

MUSICAL-INSTRUMENT HUMIDIFIERS, SYSTEMS AND METHODS

FIELD OF THE INVENTION

This invention relates to musical instrument maintenance and preservation and, more particularly, to managing humidity levels for musical instruments.

BACKGROUND OF THE INVENTION

The ability of environmental conditions to degrade and/or destroy musical instruments has long been appreciated. These issues may be of particular importance in regions of the world that experience markedly dry, or wet, humidity levels. Musical instruments are often made of various woods, laminates, bamboo, types of bone, skins, and/or similar materials, which are only well suited to a limited humidity range and/or may be somewhat exotic and/or imported from regions with different climates. These materials, such as in string instruments, are often kept under significant tension long term.

Different humidity levels, and/or changes in humidity, often result in fissures, splitting, and/or cracking in the materials within regions important to a musical instrument, such as, without limitation: a sound box; a sound board; and/or a bridge. Much of the functionality and/or distinctive qualities of a particular instrument rely on the integrity of such regions. Not only can musical instruments be very valuable and expensive to replace, but many musical instruments are distinctive, or one of a kind, with attributes that create unique qualities of sound that are difficult, if not impossible, to replace.

To prevent and/or mitigate such damage, moist cloths, moist sponges, and/or reservoirs of liquid, with or without absorbent material to wick evaporating liquid from the reservoirs, are often placed in the carrying cases of musical instruments. However, the contribution of such measures to humidity levels within a case, or within the musical instrument if a moist material is placed therein, is difficult to control. Also, such measures can themselves cause damage, such as warping, where the reservoir spills and/or a moist material comes directly in contact with the musical instrument. Also, musical instruments are often not stored in their cases, but are rather placed on display and/or left out for ease of access, often with the aid of a support, or holder. These concerns are such that musicians often result to expensive measures, such as humidity control systems for entire rooms in which musical instruments are stored, displayed, and/or used.

SUMMARY

After analysis of existing approaches to musical-instrument maintenance, several deficiencies that need to be addressed by innovation were discovered, many of which are disclosed herein. For example, systems and/or methods are needed to provide a solution for maintaining humidity levels to preserve a musical instrument long term and that protect against potential risks of unintended damage. Such systems and/or methods should be mechanically simple, adjustable, responsive to changing conditions, and/or protect certain particularly sensitive and/or important regions of the instrument. These systems and/or methods should not require the instrument to be stored in its case and/or require installation of expensive and/or cumbersome systems, but be designed for ease of application and/or removal and/or to utilize existing infrastructure for instrument storage.

Non-limiting examples of such system may include a receptacle operable to hold a supply of liquid that may last for an extended period of time. Tubing may be attached to the receptacle and provide a channel for the liquid from the receptacle into a breathable housing. The breathable housing may be sized for placement within a resonance chamber of a musical instrument.

In some examples, the receptacle may be of a size larger than could readily be inserted in and/or fit within the musical instrument, but may feed the breathable housing, which can be inserted and/or fit easily therein, with the supply of liquid for an extended period. A storage structure may be provided within the housing to collect liquid flowing from the receptacle. Additionally, the storage structure may be operable to store the liquid during evaporation. Upon evaporation, the liquid may contribute to ambient humidity by being released through the breathable housing.

In circumstances involving an instrument holder, a fastener extending from the receptacle, the instrument holder, and/or both may be provided. The fastener may be operable to be attach the receptacle to an instrument holder. The fastener may attach the receptacle at a location above the resonance chamber of the musical instrument supported by the instrument holder. Consequently, the receptacle can simply drip feed the liquid from the receptacle into the channel provided through the tubing and into the housing for collection by the storage structure.

In some examples, the system may further comprise a flow regulator within the channel passing through the tubing. The flow regulator may be operable to control a flow rate of the liquid flowing from the receptacle through the tubing into the housing and collected by the storage structure. The regulator may be used to indirectly control humidity levels by regulating the delivery of the liquid evaporated to increase humidity, be used to adapt to changing humidity levels and corresponding requirements for liquid to evaporate, and/or prevent damage that may result from surplus delivery of the liquid. In some examples, the flow regulator may include a solenoid valve. Such a solenoid valve may be operable to block off a flow of the liquid through the tubing, when disposed in an engaged position, and to permit the flow when disposed in a disengaged position.

Certain examples may include a hygrometer sized for placement within the resonance chamber, together with the housing. The hygrometer may be operable to make humidity measurements within the resonance chamber. Some of such examples may also include logic communicatively coupled to the flow regulator and/or the hygrometer.

The logic may be operable to receive the humidity measurements from the hygrometer and to determine the flow rate through the tubing for the liquid collected by the storage structure. The logic may be configured, whether directly and/or by implementing code, to arrive at the determination of the flow rate to achieve a predetermined range of humidity within the resonance chamber based on the humidity measurements. Thereafter, the logic may also control a position of the flow regulator to achieve the flow rate. By way of a non-limiting example, for examples in which the flow regulator includes a solenoid valve, the logic may provide the solenoid valve with control signals to control the position of the solenoid valve. Consequently, such approaches may be responsive to changing humidity conditions.

As one approach to protecting against potential risks of doing damage to the instrument, some examples may include an overflow structure. The overflow structure may be disposed within the housing, and/or below the storage structure, and be operable to collect a portion of the liquid overflowing the storage structure. As another non-limiting protection approach, certain examples may include a moisture detector, which may be disposed within the housing and below the storage structure.

The moisture detector may be communicatively coupled to the flow regulator directly and/or indirectly. Where the moisture detector is coupled indirectly, it may be indirectly coupled by way of the logic operable to provide control signals to the flow regulator. Regardless, the moisture detector may be operable to make and send a moisture measurement indicative of the liquid overflowing the storage structure to inform a determination of the flow rate controlled by the flow regulator. As can be appreciated, the foregoing summary necessarily leaves out not only several ways in which the disclosed innovations may be implemented, but also leaves out several potential aspects of the innovations conveyed herein, many of which are presented in the more detailed discussion below.

BRIEF DESCRIPTION OF THE DRAWINGS

In order improve understanding of the advantages of the disclosures herein, the detailed description provided below will reference specific examples illustrated in the appended drawings. These drawings depict only typical examples and are not to be considered limiting in scope. The accompanying drawings, as briefly described below, include.

DETAILED DESCRIPTION

Figure 1:
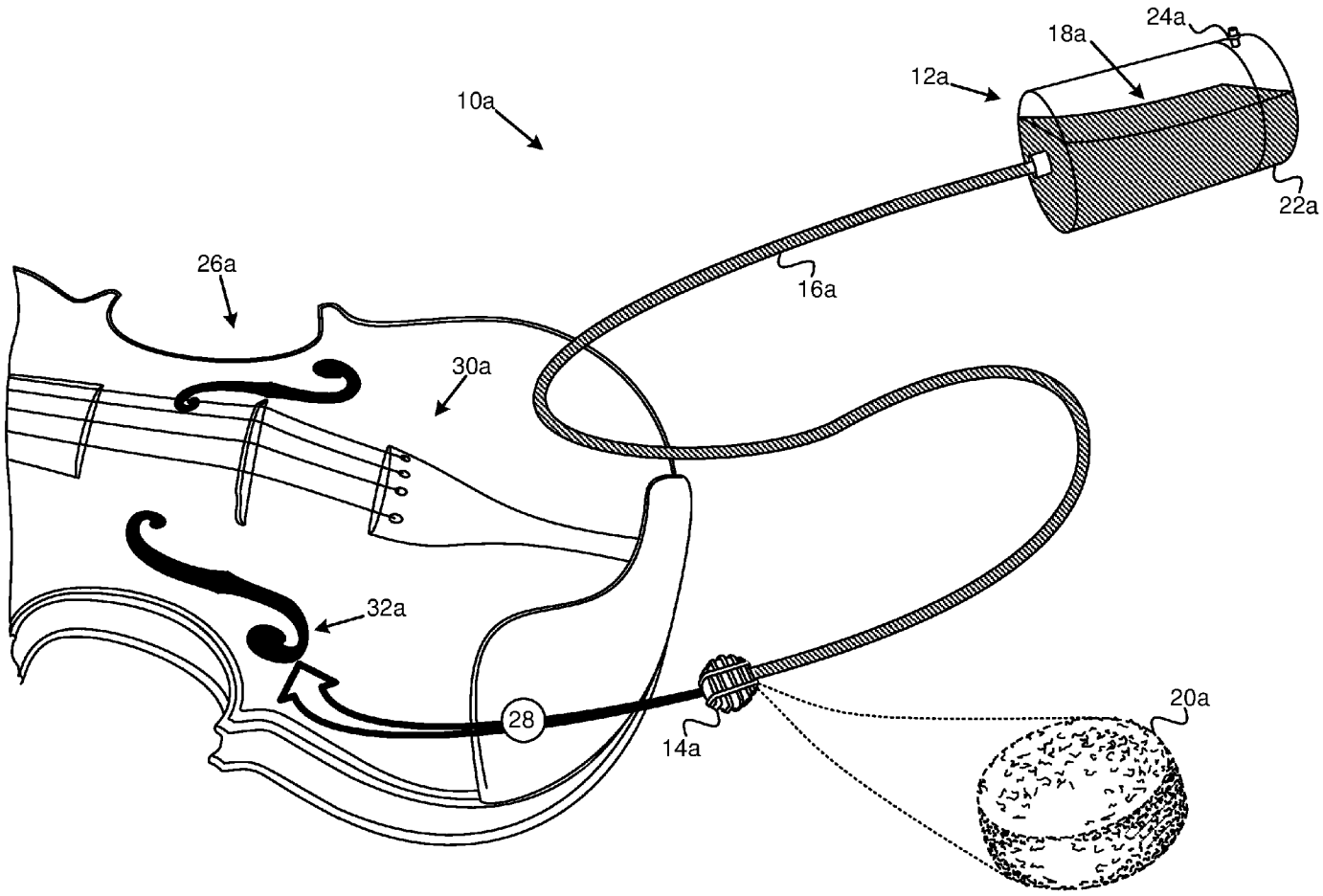
FIG. 1, depicting a perspective view of a fluid reservoir, operable to hold a long-term supply of fluid, with tubing allowing the fluid to flow into a fluid trap within a breathable housing, which may be inserted in a musical instrument, in accordance with examples.

The detailed description that follows, making reference to the figures, is not provided to limit the scope of the claimed subject matter, as claimed, but to merely provide certain representative examples. Hence, as can be appreciated, the components of the present innovations, as generally described and illustrated in the figures herein, may follow a wide variety of different designs and/or be structured in a wide variety of different configurations. In the drawings referenced herein, like parts are designated by like numerals throughout. In some cases, particular instances of an element in a figure may be identified with an identification number followed by a letter, where the letter may change for the same identification number, indicating differing instances of the element with the same or varying attributes. References to such elements by number only in the specification may refer more generally to a class of such elements and/or a representative instance of the class.

Referring to FIG. 1, a perspective view of an exemplary humidifier system 10*a* is depicted. Included with the system 10*a* are a fluid tank 12*a* a capsule 14*a*, and a conduit 16*a* through which fluid 18*a* from the fluid tank 12*a* may flow into the capsule 14*a*. A fluid trap 20*a* may be disposed within the capsule 14*a*. The fluid trap 20*a* may be operable to retain the fluid 18*a*, delivered from the fluid tank 12*a* into the capsule 14*a*, while the fluid 18*a* evaporates.

As used herein, the terms "fluid tank," "receptacle," and "fluid reservoir" may be used interchangeably. Similarly, the terms "capsule," "breathable housing," and "sound-box insert" may be used interchangeably. Also, the terms "conduit," "tubing," and "duct" may be used interchangeably. Additionally, the terms "fluid," "liquid," and "evaporative fluid" may be used interchangeably. Furthermore, the terms "fluid trap," "storage structure," and "fluid-retainer" may be used interchangeably. Within each of these five groups of terms, any of the attributes associated with any one or more of the terms in a group are ascribable to any other term in the group, unless otherwise stated.

The fluid tank 12*a* may consist of any number of materials, such as, without limitation, a plastic, a glass, a ceramic, a metal, and/or wood, that may be operable to hold a supply of fluid 18*a*. In some examples, the fluid tank 12*a* may be provided with a lid, top, and/or cap 22*a* that may be openable and/or removable to refill the fluid 18*a*. The lid 22*a* may or may not provide a water tight seal achievable through threaded ends of the main body of the fluid tank 12*a* and/or top 22*a*, a snap mechanism, and/or any other mechanism for attaching a cap 12 to a receptacle known to one of ordinary skill. In some examples, the main body of the fluid tank 12*a* and/or the lid 22*a* may be provided with an air inlet 24*a*. The air inlet 24*a* may provide an air passage to prevent a vacuum from forming in the fluid tank 12*a* that might otherwise impede the flow of the fluid 18*a* from the fluid tank 12*a*. In certain examples, the air inlet 24 may include an air valve that may be opened to provide an air passage and closed for an air tight seal.

The fluid 18*a*, used for preserving local humidity levels, may be, without limitation, water and/or an aqueous solution. In examples, including an aqueous solution, the solution may have additives that act to preserve a musical instrument 26, add fragrance, disinfect the musical instrument 26, and/or provide color, among other functionalities. In some examples, the fluid 18*a* may be, or include, an evaporative oil selected so that its vapors may act to season, coat, and/or preserve the musical instrument 26, among other functionalities.

As discussed, a conduit 16, disposed between the fluid tank 12 and the capsule 14 may deliver the fluid 18 into the capsule 14. In some examples, the conduit 16 may be flexible, as in examples utilizing pneumatic tubing and/or clear medical tubing. Materials for the conduit may include, without limitation, polyurethane, PolyVinyl Chloride (PVC) with a softening agent, such as, without limitation, Diethylhexylphthalate (DEHP) and/or substitutes thereof, a natural or synthetic rubber, and/or the like. In examples, where the conduit 16 is rigid, example materials may include, without limitation, a rigid plastic, a glass, and/or aluminum.

In some examples, the length of conduit 16 may be determined to allow the capsule 14 to be extended, from a location at which the fluid tank 12 is positioned, into a musical instrument 26. Also, the diameter of a channel within the tubing 16 may be determined to provide a diameter enabling: a potential maximum flow rate for the fluid 18; a flow rate that may feed sufficient fluid 18 into the fluid trap 20 such that, upon evaporation, the fluid 18 contributes sufficiently to ambient humidity for a certain humidity environment; a safe flow rate that will allow the fluid 18 to safely evaporate from the fluid trap 20 without overflowing; and/or, without limitation, one or more mechanisms for inducing the flow of the fluid 18 into that sound-box insert 14. The mechanism for producing the flow may vary and may include, without limitation one or more of mechanisms, such as: a drip feed mechanism, with or without a valve; utilization of a pump, such as, without limitation, a peristaltic pump; capillary action; osmotic pressure; pressurizing the fluid tank 12, and/or any other mechanism to draw the fluid 18 from the fluid tank 12, through the conduit 16, and into the capsule 14.

The capsule 14, also referred to herein as a breathable housing 14, may be provided with one or more air passageways to allow moisture and/or vapor, from the fluid 18 evaporating from the fluid trap 20, to diffuse outside the capsule 14 and contribute to ambient humidity and/or vapor pressure. In examples consistent with FIG. 1, and without limitation, the capsule 14 may be made breathable by being formed as a cage-like structure. The bars of such a structure may be provided with one or more thicknesses sufficient to provide a barrier between the moistened fluid trap 20 and a musical instrument 26, preventing moisture damage. Also, in examples with a stiff and/or rigid duct 16, the stiffness and/or rigidity of the duct 16 may be utilized to hold the capsule 14 and/or the fluid trap 20 away from interior walls within the musical instrument 26.

In some examples, without limitation, the capsule 14 may enclose the fluid trap 20 in a shell with gaps, holes, or passageways therein to allow moisture and/or vapor to escape. In such examples, a cage-like structure may also be provided around the shell to provide further distance between the fluid trap 20 and a musical instrument 26. The foregoing structures 14 may be made of a durable, fluid-resistant plastic and/or any number of suitable materials and/or combinations thereof. In some examples, the material may be rubberized to prevent scuffing and/or scratching the musical instrument 26. The capsule 14 may, in some examples be openable and/or resealable, allowing access to clean, replace, and/or swap out the fluid trap 20 and/or other potential components.

The fluid trap 20, also referred to herein as a storage structure 20, may be made of a variety of different materials. The storage structure 20 may collect the evaporative fluid 18 delivered into the breathable housing 14 and may store the evaporative fluid 18 as it evaporates, through at least one gap in the insert 14, into a space within a sound box 30, and/or other region in a musical instrument 26. In FIG. 1, the storage structure **20*a* is depicted as a sponge disk 20*a*, which may be a shaped from a natural sponge, synthetic sponge, or combination of both. A sponge is able to absorb a large amount of fluid 18, provides a large amount of surface area for evaporation, and/or is highly shapeable, light, and/or compressible during insertion 28**, among other attributes.

However, any number of additional and/or different materials, and/or combinations thereof may be utilized. By way of providing non-limiting examples, such materials may include felt, and/or some other absorbent and/or wicking cloth, and/or various foams, and/or other porous materials. In some examples, the storage structure 20 may include a cavity operable to collect the evaporative fluid 18 and hold it during evaporation, whether or not the cavity is shaped to mitigate the potential for spilling the fluid 18. The material(s), shape(s), and/or dimensions of the storage structure 20 may be selected and/or designed for, and/or to influence, the evaporation rate of the fluid 18 collected by the storage structure 20.

The capsule **14*a*, also referred to herein as a sound-box insert 14*a*, may be sized, and/or otherwise configured, such as, without limitation, made flexible, to be inserted 28, and/or placed 28, within a musical instrument 26*a*, such as a violin 26*a*. Because the capsule 14*a* is insertable, the musical instrument 26 need not be stored within its case to manage humidity. The musical instrument 26*a* itself may provide an enclosure, such as, without limitation, within a sound box 30*a*, to help retain moisture and/or vapor evaporating from the fluid 18 and provide a local, protective ambient humidity. Furthermore, the capsule 14*a* may be inserted 28 within a region of the musical instrument 26*a* that is critical to the sound qualities of the musical instrument 26*a*, such as, without limitation, a sound-box region 30*a***, and/or its long-term preservation, such as, without limitation under a bridge.

As can be appreciated from FIG. 1, the ability to fit inside a musical instrument **26*a*, such as, without limitation, within a sound-box region 30*a* and/or to pass through an opening, such as, without limitation, a sound hole 32*a*, places restrictions on the volume of fluid 18*a* that the fluid trap 20*a*, also referred to herein as a fluid-retainer 20*a*, may hold when it is inserted 28 into the musical instrument 26*a*. These restrictions on the volume of the fluid 18*a* have implications for the amount of fluid 18*a*** that may be evaporated to contribute to humidity and/or vapor pressure and/or the duration over which evaporation at desired levels may take place.

However, by connecting the capsule **14*a*, via tubing 16*a* that is narrow relative to the capsule 14*a*, to a fluid reservoir 12*a* disposed outside a sound box 30*a* of a musical instrument 26*a*, these restrictions may be overcome. Such a fluid reservoir 12 may hold an evaporative fluid in any volume desired. Not only does the delivery of fluid 18 from the fluid reservoir 12 alleviate the need to constantly refill a humidifying device, check for the presence of the fluid, and/or wonder whether a remaining amount of fluid is sufficient to provide sufficient moisture and/or vapor, but the size of the volume that may be stored in the fluid reservoir 12** opens up new opportunities.

For example, and without limitation, a musical instrument 26 may be left with the humidifier system 10 during an extended vacation by the owner of the musical instrument 26. Also, without limitation, the musical instrument 26 may be placed in long term storage with its humidity requirements addressed. By way of another non-limiting example, the musical instrument 26 may be kept outside its case for easy access, where the capsule 14 may simply be pulled out of the musical instrument 26 before playing and reinserted 28 after playing.

In some examples, various metrics of the aforementioned components of a humidifier system 10 may be designed to provide a steady supply of fluid 18 from the fluid reservoir 18 to evaporate within the musical instrument to maintain a target range for humidity and/or vapor pressure, without overflowing the fluid-retainer 20. No-limiting examples of such metrics may include the viscosity of the fluid 18, the diameter of the tubing 16, the surface area of the fluid-retainer 20, and/or the cumulative dimension of the air passages in the breathable housing 14, among others. In certain of such examples, these metrics may be designed for ranges of humidity, and/or durations for different humidity levels, experienced in different regions of the world.

However, humidity levels may vary widely in a region, such as a result of weather patterns, making dynamic control of flow rate desirable. In some examples, automation of the oversight of such control may also be desirable. Additional innovations, such as those discussed below with the help of the following figure, may be provided to address such issues.

Figure 2:
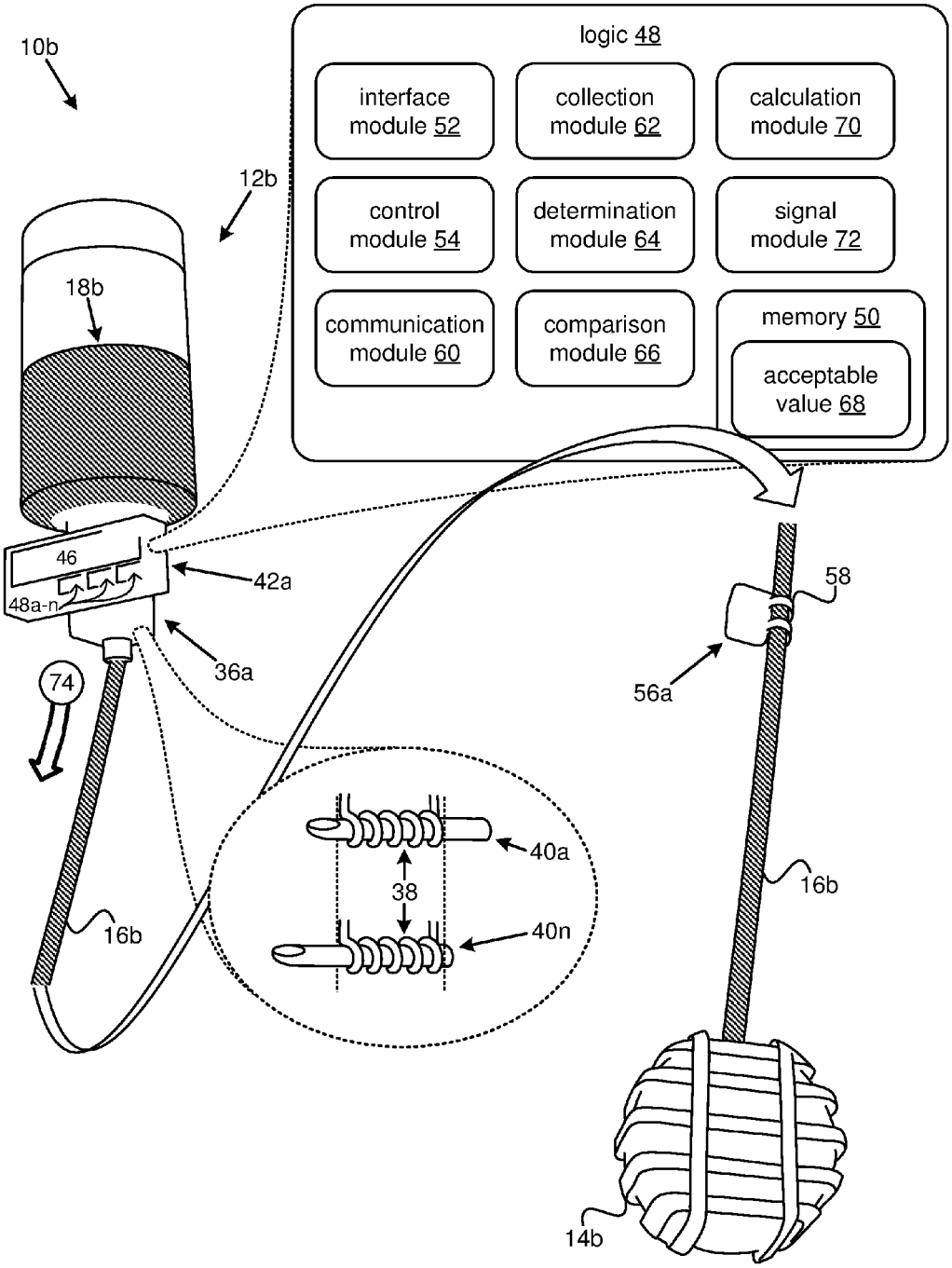
FIG. 2, depicting a perspective view of a flow regulator, measuring device, and logic, any of which may work together to manage a flow rate from the depicted fluid reservoir into the breathable housing and, hence, humidity within a musical instrument enclosing the breathable housing, in accordance with examples.

Referring to FIG. 2, a perspective view is depicted of a humidifier system 10*b* that includes a flow regulator 36*a*. The humidifier system 10*b* depicted in FIG. 2 may include components and/or elements that may be the same as, and/or similar, but different, to, those described above with respect to the previous figure. For example, the humidifier system 10*b* may include a receptacle 12*b* that may hold a liquid 18*b* that may be delivered through tubing 16*b* into a breathable housing 14*b*.

However, as stated, FIG. 2 also depicts a flow regulator 36*a* that may be disposed in the channel passing through the tubing 16*b*. The flow regulator 36*a* may be used to control the flow rate of the liquid 18*b* through the tubing 16*b*. Hence, a user of the a humidifier system 10*b* may adjust, calibrate, and/or set the flow regulator 36*a* to manage delivery of the fluid 18*b* through the conduit 16*b* and into the housing 14*b*. For example and without limitation, in some examples an adjustable valve 36, coupled with the conduit 16, may serve as the flow regulator 36*a*. As used herein, the terms "flow regulator," "control gate," and "adjustable valve" may be used interchangeably, with any of the attributes associated with any one or more of the terms in the group ascribable to any other term, unless otherwise stated.

In some, but not all, examples, a flow regulator 36 may include a solenoid valve 38. The solenoid valve 38 may be disposed in: an open, or disengaged, position 40*a*; a closed, or engaged, position 40*n*; any number of discrete intermediate positions; and/or any position along a continuum between the disengaged position 40*a* and the engaged position 40*n*. The disengaged position 40*a* may permit a free flow of the liquid 18*b* at a maximum flow rate achievable within the tubing 16*b*. The engaged position 40*b* may completely block the flow, with the intermediate positions permitting a range of intermediate flow rates. Similar ranges in flow rates may be obtainable by alternative approaches.

By way of providing another example of another, non-limiting approach to implementing a flow regulator 36, the flow regulator 36 may include a mechanical valve and/or spigot. In some examples, pressure may be applied and/or released to pinch off and/or enlarge a control gate 36 through which the evaporative fluid must pass to flow through the duct 16 into the fluid-retainer 20 to produce a full range of flow rates. Also, without limitation, in examples involving a peristaltic pump, the speed of the peristaltic pump may be adjusted. As can be appreciated, other mechanisms and/or approaches to controlling the flow of the liquid 18*b* may be relied upon by the flow regulator 18.

As can be appreciated, inclusion, in a humidifier system 10, of a flow regulator, control gate, and/or adjustable valve 36, through which the evaporative fluid 18 must pass to flow through the duct 16 into the fluid-retainer 20, may provide a point of interaction with the humidifier 10. This point of interaction may be used for adjusting flow rates to differing weather and/or climatic conditions and/or for calibrating, fine tuning, or otherwise adjusting a flow rate for a particular musical instrument 26, among other objectives. In some examples, the point of interaction may include a knob, a switch, a slider, and/or the like. Also, in some examples, such as depicted in FIG. 2, additional infrastructure 42*a* may be included with the adjustable valve 36*a*.

By way of example and not limitation, such additional infrastructure 42 may include one or more screens 44 operable to display information, such as, without limitation, flow rate and/or flow-regulator-position information. Such a screen 44 may be, by way of example and not limitation: a Liquid crystal display (LCD); a cathodoluminescence screen, such as, without limitation, a Cathode Ray Tube (CRT) screen; an electroluminescence screen, such as, without limitation, a Light Emitting Diode (LED) screen and/or an Organic LED (OLED) screen; and/or a photoluminescence screen. Additionally, and/or in the alternative, one or more types of analogue and/or digital gauges may also be provided to display one or more of such measurements.

Also, or in the alternative, by way of example and not limitation, such additional infrastructure 42 may include one or more buttons, dials, and/or the like 46*a-n* to receive one or more commands to adjust the control gate 36. Similarly, in examples involving a screen 44, the screen 44 may be a touch screen, such as, without limitation, a capacitive touch screen and/or a resistive touch screen, operable to receive such commands. In some examples, the additional infrastructure 42 may include logic 48 and/or memory 50 which may provide the infrastructure for one or more modules, which may be operable to provide one or more functionalities discussed with respect to elements disclosed herein. As used herein, the terms "logic," "hardware logic," and "management logic" may be used interchangeably, with the attributes associated with any one or more of the terms ascribable to any other term, unless otherwise stated.

Modules may take the form of an entirely hardware embodiment, an entirely software embodiment (including firmware, resident software, micro-code, etc.), or an embodiment combining software and hardware aspects. Furthermore, aspects of the presently discussed subject matter may take the form of a computer program product embodied in any tangible medium of expression having computer-usable program code.

With respect to entirely hardware embodiments, the hardware embodiments may be implemented on logic 48 that may include, without limitation, a Field Programmable Gate Array (FPGA), an Application-Specific Integrated Circuit (ASIC), off the shelf electronic components, such as, without limitation, a Dual Inline Package (DIP), and/or a Printed Circuit Board (PCB), among other examples of dedicated logic. With respect to software aspects, any combination of one or more computer-usable or computer-readable media may be utilized, which may include, without limitation, memory 50. Memory 50 may include, without limitation, Random Access Memory (RAM), Dynamic RAM (DRAM), Static RAM (SRAM), and/or fast CPU cache memory, among other possibilities.

Additionally, or in the alternative, a computer-readable medium may include one or more of a portable computer diskette, a hard disk, a random access memory (RAM) device, a read-only memory (ROM) device, an erasable programmable read-only memory (EPROM or Flash memory) device, a portable compact disc read-only memory (CDROM), an optical storage device, and a magnetic storage device. In selected embodiments, a computer-readable medium may comprise any non-transitory medium that may contain, store, communicate, propagate, or transport the program for use by, or in connection with, an instruction execution system, apparatus, or device.

Aspects of a module that are implemented with software may be executed on the logic 48, which may include a micro-processor, Central Processing Unit (CPU), and/or the like. Any hardware aspects of the module may be implemented to interact with software aspects. For software aspects, computer program code for carrying out operations of the present invention may be written in any combination of one or more programming languages, including an object-oriented programming language such as C++, conventional procedural programming languages, such as the "C" programming language, an assembly language, or similar programming languages.

Some examples may include an interface module 52 operable to configure a screen 44 and/or gauge to display information, such as, without limitation, flow rate and/or flow-regulator position information. Additionally, or in the alternative, in examples where the screen 44 is a touch screen, to receive commands for implementation by the flow regulator 36. Certain examples may include a control module 54 that may be operable to send electrical signals and/or provide power to adjust the flow regulator 36 responsive to one or more control buttons and/or dials 46*a-n* and/or to implement one or more commands received via a touch screen.

However, by itself, a flow regulator 36, even with additional infrastructure 42, as discussed above, does not enable a humidifier system 10 to be autonomously responsive to changing conditions. To enable a humidifier system 10 to become autonomously responsive to changing conditions, among other elements, a measurement device 56*a* may be incorporated within the humidifier system 10*b*. Such a measurement device 56 may be operable to measure ambient conditions, such as, without limitation, ambient humidity. By way of providing another non-limiting example, such a condition may also include temperature. In some examples, the measurement device 56 may be and/or include a hygrometer 56 and/or moisture meter 56. Such a hygrometer 56 may be used, for example, for collecting humidity level data in a sound box 30.

Also, in certain examples, the measurement device 56 may be operable, and/or configured, to be placed within a musical instrument 26. In such examples, the measurement device 56 may measure ambient conditions, such as humidity, within the musical instrument 26 and/or within a region thereof, such as a sound box 30. For example, as depicted in FIG. 2, the measurement device 56*a* may be affixed to the tubing 16*b* in a region sufficiently near to the sound-box insert 14*b* that the measurement device 56*a* may be inserted, and/or placed, 28 through a sound hole 32 into a sound box 30 together with the sound-box insert 14*b*. Potentially, the measurement device 56 may be affixed to the tubing 16 by one or more bands 58, but allow the measurement device 56 to be slid up and/or down the tubing 16 to adjust the position of the measurement device 56 relative to the insert 14 so that it is close enough to the sound-box insert 14 to be inserted 28 therewith, but not too close to skew measurements of the general ambient humidity.

Furthermore, the measurement device 56 may be made operable to communicate one or more measurements of the ambient conditions, directly and/or indirectly, to the adjustable valve 36. In such examples, a communication module 60, which may be provided with the additional infrastructure 42, may be operable to communicate with the measurement device 56 and/or to receive one or more measurements, such as, without limitation, humidity data from within a resonance chamber 30, from the measurement device 56. Potentially, a collection module 62 may also be provided to collect the one or more measurements from the communication(s).

A determination module 64 may be provided with the additional infrastructure 42 for certain examples. Based on the measurement(s) and/or the command(s) received through the additional infrastructure 42, such a determination module 64 may be operable to determine the flow rate through the tubing 16 for the liquid 18 collected by the storage structure 20 to achieve a predetermined range of humidity within the resonance chamber 30.

Some examples may be provided with a comparison module 66, which may work in conjunction with the determination module 64, or independently. The comparison module 66 may be operable to compare, with hardware logic 48, the humidity level data to a value 68 for an acceptable humidity level. The value 68 for the acceptable humidity may include a range of acceptable levels, may be stored in a static portion of memory 50, and/or may be input and/or adjusted by one or more commands received through a screen 44, one or more buttons 46*a-n*, and/or the like.

Additionally, or in the alternative, certain examples may include a calculation module 70, which may work in conjunction with the determination module 64 and/or with the comparison module 66, or independently. The calculation module 70 may be operable to calculate, with the hardware logic 48, a value for a control metric controlling a feed rate for the evaporative fluid 18*b* passing through the duct 16*b* into the fluid-retainer 20. The calculation module 70 may calculate the value for a control metric based on a difference between the humidity level data and the value 68 for the acceptable humidity level. Non-limiting examples of such a control metric may include a desired flow rate and/or a position of a valve, spigot, slider, pinching mechanism, solenoid 38, and/or the like operable to achieve such a flow rate.

A signal module 72 may be included in some examples, which may work with the control module 54, or independently. The signal module 72 may be operable to provide an electric signal capable of adjusting, according to the calculated value for the control metric, a control gate 36 through which the evaporative fluid must pass. In other words, the signal module 72 may provide an electric signal capable of controlling a position of the flow regulator 36 to achieve a flow rate and/or of actuating a mechanism in the flow regulator 36 to adjust a position of the flow regulator 36, indirectly changing an amount of the fluid 18*b* passing through the conduit 16*b* into the capsule 14*b*.

By way of providing a non-limiting example of a system 10*b* including a flow regulator 36*a*, additional infrastructure 42*a*, and a measuring device 56*a*, the fluid reservoir 12*b*, with the supply of fluid 18*b*, may be disposed above the sound-box insert 14*b*. In such examples, the fluid reservoir 12*b* may, with the help of gravity, drip-feed 74 the fluid 18*b* from the reservoir 12*b* outside a sound box 30 to a fluid-retainer 20, within a sound-box insert 14*b* disposed within the sound box 30, through the duct 16*b* connecting the reservoir 12*b* to the insert 14*b*.

Additionally, a solenoid 38 in the flow regulator 36 may be in a disengaged position 40*a*. The measurement device 56*a* may measure elevated levels of humidity, which it may communicate to the communication module 60 for collection by the collection module 62. One or more of the determination module 64, comparison module 66, and/or the calculation module 70 may arrive at a conclusion that the elevated levels of humidity justify shutting down the flow of liquid 18 for a time. The signal module 72 may then provide an electric current through the turning of the solenoid 38, causing the core of the solenoid 38 to move to the engaged position 40*n*, blocking the flow of the liquid 18*b*, until such time as they hygrometer 56*a* provides a measurement resulting in a conclusion that the position 40 of the solenoid needs readjustment.

Figure 3:
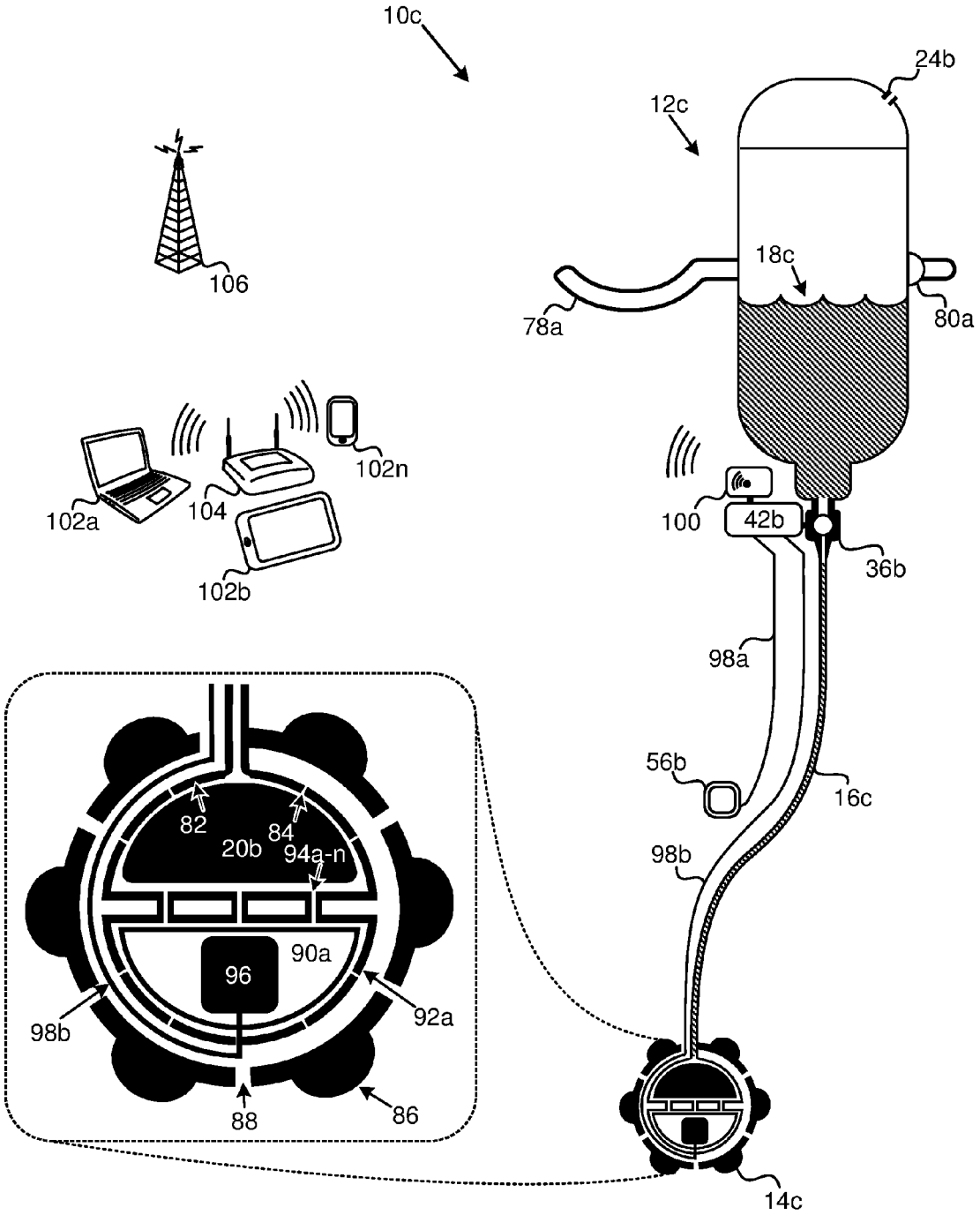
FIG. 3, depicting a schematic view of exemplary humidifier systems for long-term management of humidity within a musical instrument, including additional potential elements for some exemplary humidifiers, in accordance with examples.

Referring to FIG. 3, a schematic view of an exemplary humidifier system 10*c* is depicted, together with additional potential elements that may further the objectives of such a system 10*c*. The humidifier system 10*c* depicted in FIG. 3 may include components that may be the same as, and/or similar, in some ways, to those described with respect to previous figures. For example, the system 10*c* may include a fluid reservoir 12*c* that may hold a liquid 18*c* that may be delivered through a control gate 36*b*, which may be communicatively coupled to additional infrastructure 42*b*. The fluid 18*c* may further be delivered through tubing 16*c* into a sound-box insert 14*c* with a fluid retainer 20*b* therein that may collect the fluid 18*c*.

As one non-limiting example of an additional element, the humidifier system may include a support, stand, and/or holder 78 for a musical instrument 26. In examples consistent with FIG. 3, the holder 78 may be, without limitation, a guitar hook 78*a*. Additionally, the system 10*c* may include a fastener 80 for attaching the fluid reservoir 12*c* to an upper region of a musical-instrument holder 78 and/or of a musical instrument 26 held by the holder 78, allowing gravity to act on the fluid 18*c* so that it may be drip fed 74 from the fluid reservoir 12*c* into the fluid retainer 20*b*. Attaching the fluid retainer 20*b* to a guitar hook 78*a*, and/or similar hook 78, places the fluid retainer 12*c* in a position above much of a stringed musical instrument 26 because such a hook 78*a* engages with a stringed musical instrument 26 in the region of the upper neck.

In some examples, the fluid retainer 20*b* within the sound-box insert 14*c* may itself be enclosed within an upper cavity, or enclosure, 82 within the sound-box insert 14*c*. In such examples, the upper cavity 82 may be provided with multiple holes 84 for humidity to pass through. Furthermore, the sound-box insert 14*c*, which may be provided with protective padding 86, may also be provided with gaps 88 to allow humidity, and/or vapor, to leave the insert 14*c*.

As can be appreciated, an overflow of the liquid 18*c* within a musical instrument 26 can damage the instrument 26. Although the fluid retainer 20*b* may be designed to collect liquid 18*c* delivered from the fluid reservoir 12*c*, a potential may exist, because of the volume of the supply of liquid 18*c*, for the collecting capacity of the fluid retainer 20*b* to be exceeded and the liquid 18*c* to overflow the fluid retainer 20*b*. This potential may be of particular concern in examples without a flow regulator 36 to control the flow, a measurement device 56, and/or additional infrastructure 42 with which to automate responsive control of the flow.

An overflow structure 90*a* may be provided in some examples and may be operable to collect and/or retain a portion of the liquid 18*c* overflowing the storage structure 20*b*, preventing damage to the musical instrument 26 in which the sound-box insert 14*c* receiving the liquid 18*c* resides. An overflow structure 90 may be constituted in any of the manners in which the storage structure 20 may be constituted, including, without limitation, a sponge and/or a receptacle for holding the portion of overflowing liquid 18*c*. In some examples, the overflow structure 90 may be disposed on the outside of the insert 14. In other examples, such as examples consistent with FIG. 3, the overflow structure 90*a* may be disposed within the sound-box insert 14*c*. In such examples, the overflow structure 90*a* may be disposed within a chamber and/or enclosure 92 within the sound-box insert 14*c*, designed to hold the overflow structure 90.

In examples consistent with FIG. 3, the overflow structure 90*a* disposed within the breathable housing 14*c* below the storage structure 20*b*, may include a sponge, or other porous material, 90*a*. In such examples, the chamber 92*a* enclosing the storage structure 20*b* may also be provided with evaporative gaps, or pores, 84 that may allow overflowing liquid 18*c* to evaporate. In certain examples, one or more passage 94*a-n* between the storage enclosure 82 and the overflow chamber 92 may be provided to allow overflow from the storage structure 20 to reach the overflow structure 90 in a directed and/or controlled manner.

Whether in addition to, or without, the presence of an overflow structure 90, some examples may include a moisture detector 96. As used herein, the terms "moisture detector" and "moisture sensor" may be used interchangeably, with attributes associated with either term ascribable to the other, unless otherwise stated. A moisture sensor 96 may be implemented in a variety of forms, from a simply circuit that relies on the presence of the liquid 18 for its completion at one or more high liquid marks in the overflow structure 90, to more complicated forms, such as, without limitation a moisture meter used to determine a percent of liquid content in the overflow structure 90. The moisture sensor 96 may be coupled with the capsule 14 and may be disposed within, or outside of, the housing 14. The moisture sensor 96 may be operable to sense a presence of the fluid 18*c* outside the fluid trap 20. In some examples, the moisture detector 96 may be operable to detect evaporative fluid 18 in an overflow region, whether on the inside or outside of the sound-box insert 14, or separate from the insert 14.

In examples consistent with FIG. 3, a moisture detector 96 may be disposed below the storage structure 20, where it may be operable to make measurements. The moisture sensor may be operable to simply detect the presence of the liquid 18 and/or may be operable to provide a measurement indicating a volume of liquid 18 present. As with the measurement device 56, the moisture detector 96 may be communicatively coupled to the flow regulator 36 directly and/or indirectly. Such communication couplings may be achieved either wirelessly, such as, without limitation, by BLUETOOTH and/or an infrared communication link, and/or by one or more wires 98, such as the first wire 98*a* connecting the measurement device 56*b* to the additional infrastructure 42*b* and the second wire 98*b* connecting the moisture sensor 96 to the additional infrastructure 42*b* in FIG. 3.

Where the moisture detector 96 is indirectly communicatively coupled to the flow regulator 36*a*, as in FIG. 3, it may first be connected to the additional infrastructure 42*a* and/or logic 48, which may be operable to provide control signals to the flow regulator 36*a*. Consequently, in some examples, the moisture sensor 96 may be operable to send a moisture measurement to the flow regulator 36, the additional infrastructure 42, and/or the logic 48, the measurement potentially being indicative of the liquid 18 overflowing the storage structure 20 to inform a determination of the flow rate controlled by the flow regulator 36. Hence, the moisture sensor 96 may indicate the presence of the fluid 18 outside the fluid trap 20 to the adjustable valve 36 directly and/or indirectly. As a result, the flow regulator 36, the additional infrastructure 42, and/or the logic 48 may control the flow regulator 36 to restrict, whether completely or by degrees, a flow of the evaporative fluid 18 through the duct 16 into the fluid-retainer 20.

In examples where management logic 48 may be communicatively coupled to a measurement device 56 and/or a moisture sensor 96, the management logic 48 may be operable to receive a measurement from the measurement device 56 and/or an indication of the presence of the liquid 18 from the moisture sensor 96. The management logic 48 may then convert the measurement and/or the indication of the presence to an adjustment signal. The adjustment signal may be communicated to the adjustable valve 36 and/or be applied for adjusting a position of the adjustable valve 36, changing an amount of the fluid 18 passing through the conduit 16 into the capsule 14. Depending on the example, one or more portions of the additional infrastructure 42, logic 48, and/or memory 50 may be included with the measurement device 56 and/or a moisture sensor 96 in addition to, or as an alternative to, portions of the additional infrastructure 42, logic 48, and/or memory 50 disposed near the flow regulator 36.

Although the foregoing examples, include innovations to better insure and/or prevent water damage, additional innovations, such as the presence of a wireless transceiver 100 may provide additional, insurance, protection, and/or control. In such examples, the wireless transceiver 100 may be communicatively coupled to additional infrastructure 42, logic 48, a measurement device 56, a moisture sensor 96, and/or the flow regulator 36. Such a wireless transceiver 100 may be operable to communicate remotely with a computing device 102*a-n*, such as, without limitation, a laptop computer 102*a*, a tablet 102*b*, and/or a cell phone 102*n*.

The wireless transceiver 100 may relay information to the computing device 102 from, for example and without limitation, the hygrometer 56, measuring device 56, moisture sensor 96, additional infrastructure 42, the logic 48, and/or the memory 50. The wireless transceiver 100 may also, or in the alternative, receive one or more commands from the computing device 102 to be implemented by, for example and without limitation, the additional infrastructure 42 and/or flow regulator 36. For example, and without limitation, the wireless transceiver 100 may receive a command to adjust the control gate 36 over a communication network.

In some examples, the wireless transceiver 100 may be operable to send and/or receive information over a variety of networks, including, without limitation, a Personal Area Network (PAN), a Local Area Network (LAN), a Wide Area Network (WAN), a cellular network, the internet and the World Wide Web generally, and/or the like. Consequently, the wireless transceiver 100 may transmit humidity level data to a wireless communication network. Hence, the wireless transceiver 100 may make the humidity level data and/or other information available to a computing device 102 over the wireless communication network directly and/or indirectly, by storing the humidity level data and/or other information on a server. The wireless transceiver 100 may employ one or more of a variety of wireless technologies, such as, without limitation, BLUETOOTH, an Infrared Data Association (IrDA) protocol, Wireless Fidelity (Wi-Fi) 104, any number of cellular network protocols 106, such as, without limitation, a Long Term Evolution (LTE) protocol, and/or the like.

Figure 4:
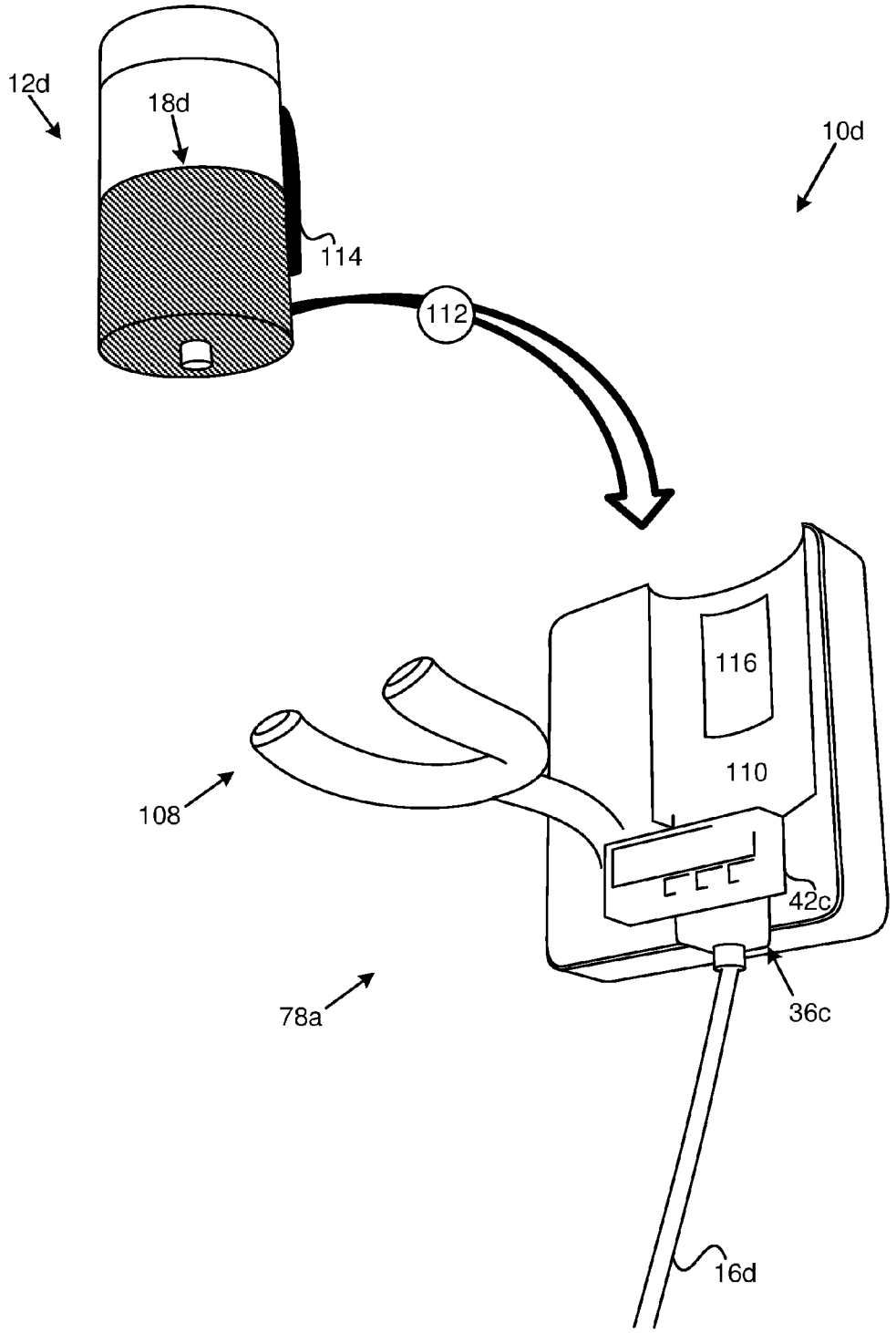
FIG. 4, depicting a perspective view of a musical instrument holder implemented with a humidifier system; in accordance with examples.

Referring to FIG. 4, a non-limiting, perspective view is depicted of a musical instrument holder 78, where the musical instrument 26 is a stringed instrument. The instrument holder 78*a* provides a forked support 108 to receive a region of a neck of the stringed instrument while preventing a broader region of the stringed instrument, disposed above the region of the neck, from slipping through the forked support, to hold the musical instrument 26. One non-limiting example of such an instrument holder 78*a* may be a guitar hook 78*a*.

Additionally, the instrument holder 78*a* may include a fluid-tank dock 110 incorporated with the instrument holder 78*a*. The fluid-tank dock 110 may be operable to receive, engage, support, and/or hold a fluid tank 12*d* placed 112 in the fluid-tank dock. In some examples, the sole mechanism for attaching the fluid tank 12 to the instrument holder 78 may be provided by the instrument holder 78. As discussed above, in alternative examples, the fluid tank 12 may be provided with a clamp, vice, strap, and/or other element 80 capable of affixing the fluid tank 12 to the holder 78. In yet further examples, both the fluid tank 12 and the instrument holder 78 my include elements for affixing the fluid tank 12 to the instrument holder 78. By way of providing non-limiting examples, as consistent with FIG. 4, the fluid tank 12*d* may be provide with a tongue 114 and the instrument holder 78 may be provided with a groove 116 operable to receive and hold the tongue 114, affixing the tank 12 to the holder 78.

Figure 5:
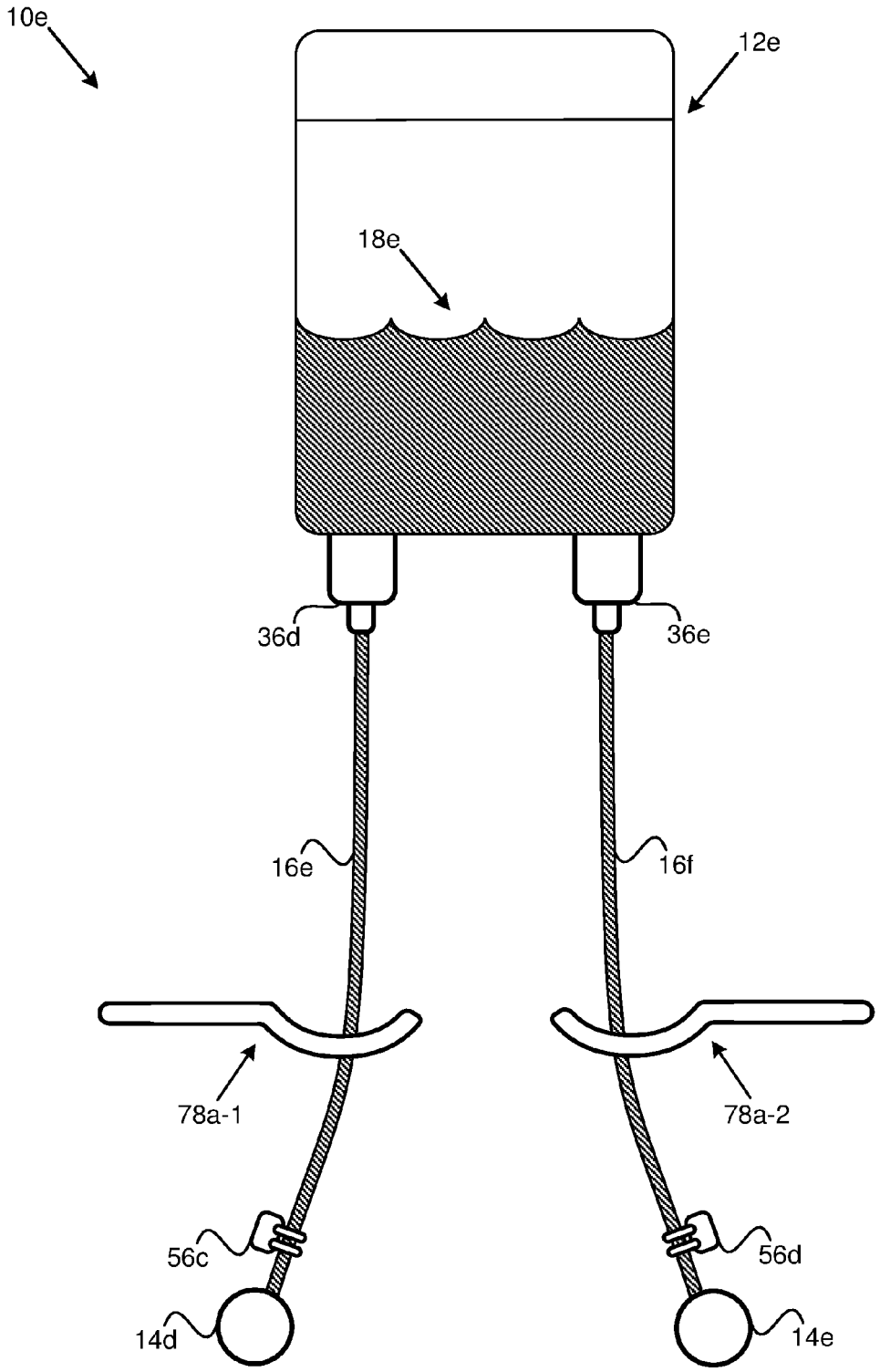
FIG. 5, depicting a schematic view of a fluid tank feeding fluid through multiple conduits to contribute to humidity levels in multiple musical instruments, in accordance with examples.

Referring to FIG. 5, additional innovations are depicted in schematic form for a humidifier system 10*e* in terms of a common fluid tank 12*e* operable to feed fluid 18*e* through multiple conduits 16*e*, 16*f* to contribute to humidity levels in multiple musical instruments 26. In the example depicted in FIG. 5, one additional conduit 16*f* is depicted, together with one additional capsule 14*e*, with an additional fluid trap 20 disposed therein, with the capsule 14*e* operable to be placed within an additional musical instrument 26. However, as can be appreciated, any number of additional conduits 16, capsules 14, and fluid traps 20 may be provided to deliver fluid 18*e* from the common fluid tank 12*e* for insertion 28 in any number of musical instruments 26, one or more of which may be held by one or more instrument holders 78*a*-1, 78*a*-2.

Also, in certain examples, one or more of the conduits 16, such as the additional conduit 16*f*, may be provided with a measuring device 56*d*. Similarly, one or more of the capsules 14, such as the additional capsule 14*f*, may be provided with an overflow structure 90 and/or a moisture sensor 96. Furthermore, in some examples, the flow of the fluid 18*e* in the multiple conduits 16 may be controlled by a common flow regulator 36. In other examples, such as those consistent with FIG. 5, the flow of the fluid 18*e* in one or more of the conduits 16 may be one or more different flow regulators 36*d*, 36*e*. In such examples, the additional infrastructure 42 and/or logic 48 can control the multiple flow regulators 36*d*, 36*e* to respond to different humidity needs and/or conditions in different musical instruments 26.

Figure 6:
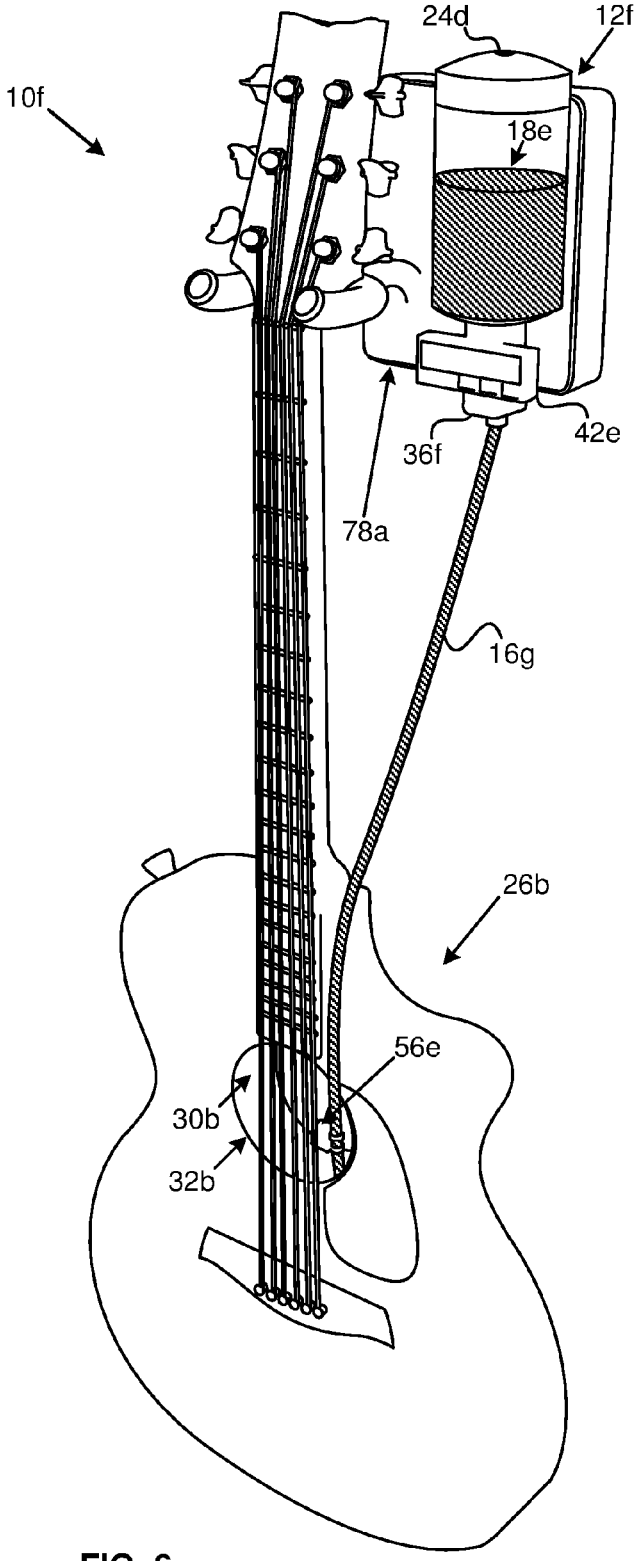
FIG. 6, depicting a perspective view of an acoustic guitar supported by a guitar hook holding a fluid tank feeding fluid controlled by a fluid regulator, responding to hygrometer measurements, into a housing within the sound box of the guitar to manage humidity levels within the sound box; in accordance with examples.

Referring to FIG. 6, use of a humidifier system 10*f*, consistent with disclosures herein, is depicted for an acoustic guitar 26*b*. The non-limiting, example humidifier system 10*f* is depicted as including a guitar hook 78*a*. The guitar hook 78*a* not only supports the guitar 26*b* by its upper neck, but also holds a fluid tank 12*f* with liquid 18*f*.

The liquid 18*f* is drip fed 74 from the fluid tank 12*f* through the conduit 16*g* with a flow rate controlled by a flow regulator 36*f*, which may be attached to the guitar hook 78*a*, or disposed elsewhere along the path of the conduit 16*g*. The fluid 18*f* flows through the conduit 16*g* into a fluid trap 20 within a sound-box insert 14 that is placed 28 through a sound hole 32*b* into the sound box 30*b* of the guitar 26*b*. The fluid 18*f* may then evaporate within the sound box 30*b*, contributing to and increasing the humidity within the sound box 30*b* to preserve and protect the guitar 26*b*.

Also depicted is a measuring device 56*e*, such as a hygrometer 56*e*, to monitor, detect, and/or measure humidity within the sound box 30*b* and communicate this information to additional infrastructure 42*e* and/or logic 48. The additional infrastructure 42*e* and/or logic 48, which is communicatively coupled to the flow regulator 36*f*, may then adjust and/or control the flow regulator 36*f* in response to the information from the measuring device 56*e* to maintain a target humidity within the guitar 26*a*. As can be appreciated, the humidifier system 10*f* may be applied to the guitar 26*a* with as much ease as the guitar 26*a* can be stored on the guitar hook 78*a*, by merely dropping 28 the sound-box insert 14 into the sound hole 32*b* of the guitar 26*b*. Similarly, the system 10*f* may be disengaged by merely pulling the sound-box insert 14 out of the sound hole 32*b*, with as much ease as removing the guitar 26*b* from the guitar hook 78*a*.

Figure 7:
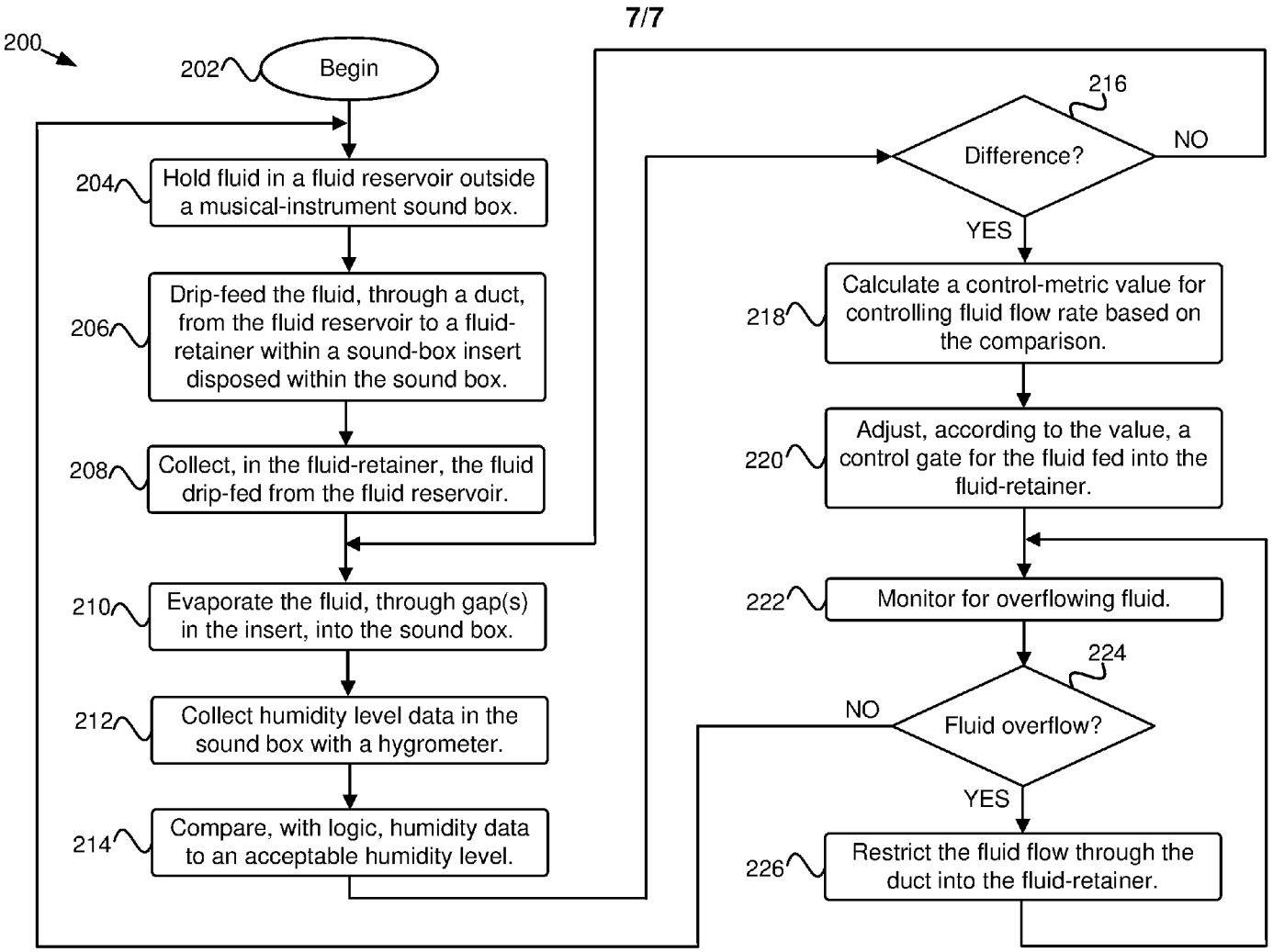
FIG. 7 is a flow chart of steps for managing humidity in a musical instrument, in accordance with examples.

Referring to FIG. 7, a flowchart 200 depicts steps for increasing, monitoring, and controlling humidity within a musical instrument 26. The flowchart 200 illustrates the architecture, functionality, and/or operation of possible implementations of systems, methods, and computer program products according to examples. In this regard, each block in the flowchart 200 may represent a module, segment, or portion of code, which comprises one or more executable instructions for implementing the specified logical function(s). It will also be noted that each block of the flowchart illustrations, and combinations of blocks in the flowchart illustrations, may be implemented by special-purpose, hardware-based systems that perform the specified functions or acts, or combinations of special-purpose hardware and computer instructions.

Where computer program instructions are involved, these instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart 200 and/or block or blocks. These computer program instructions may also be stored in a computer readable medium that may direct a computer to function in a particular manner, such that the instructions stored in the computer-readable medium produce an article of manufacture including instruction means which implement the function/act specified in the flowchart 200 and/or block or blocks.

It should also be noted that, in some alternative implementations, the functions noted in the blocks may occur out of the order noted. In certain embodiments, two blocks shown in succession may, in fact, be executed substantially concurrently, or the blocks may sometimes be executed in the reverse order, depending upon the functionality involved. Alternatively, certain steps or functions may be omitted.

Operations in methods 200 consistent with FIG. 7 may begin 202 by holding 204 an evaporative fluid 18 in a fluid reservoir 12 disposed outside a sound box 30 of a musical instrument 26. The evaporative fluid 18 may be drip-fed 206 from the fluid reservoir 12 to a fluid-retainer 20, within a sound-box insert 20 disposed within the sound box 30, through a duct 16 connecting the fluid reservoir 12 to the sound-box insert 14. The fluid-retainer 20 may collect 208 the evaporative fluid 19 drip-fed from the fluid reservoir 12 and evaporate 210 the evaporative fluid 18 through one or more gaps 88 in the insert 14 into a space within the sound box 30.

Additionally, in some, but not all examples, methods 200 may collect 212 humidity level data in the sound box 30 with a hygrometer 56. Such methods 200 may compare 214, with hardware logic 48, the humidity level data to a value 68 for an acceptable humidity level. If a determination 216 as to whether there is a difference does not find a significant difference, methods 200 may return to steps 210 through 216. In such scenarios, steps 204 through 208 may or may not proceed apace in the background, depending on the example. If the determination 216 finds that a deference exists, methods 200 may proceed by calculating 218, with hardware logic 48, a value for a control metric controlling a feed rate for the evaporative fluid 18 passing through the duct 16 into the fluid-retainer 20 based on a difference between the humidity level data and the value 68 for the acceptable humidity level. A control gate 36, through which the evaporative fluid 18 must pass to flow through the duct 16 into the fluid-retainer 20, may be adjusted 220 according to the value for the control metric.

In some, but not all examples, methods 200 may proceed by monitoring 222 for fluid 18 overflowing the fluid retainer 20. In such examples a determination 224 may be made as to whether fluid 18 has overflown the fluid-retainer 20. Where fluid overflow is detected, the fluid flow through the duct 16 into the fluid-retainer 20 may be restricted 226. In certain examples, after the fluid flow is restricted 226, the monitoring 222 may continue. Where fluid overflow is not detected, certain methods 200 may proceed by returning to steps 202 through 214.

In examples where 212 collection of humidity level data does not occur, methods 200 may proceed directly to monitoring 222 for overflowing fluid 18, or, where monitoring 222 also does not take place, methods 200 may simply repeat steps 202 through 210. In examples where 212 collection of humidity level data occurs, but monitoring 222 does not occur, methods 200 may return to steps 210 through 216 after adjusting 220 the control gate 36, with steps 204 through 208 continuing, or not continuing, in the background, depending on the example. In other examples, monitoring 222 for fluid overflow may take place before making a determination 216 about a difference between humidity levels and an acceptable level. In such examples, the determination 224 about the presence of fluid overflow may also take place before, and/or figure into, the calculation step 218 and/or the adjustment step 220. As can be appreciated, other variations are also possible.

As can also be appreciated, the present disclosures in this application may be embodied in other specific forms, aside from those discussed with respect to the various figures described herein, without departing from their spirit or essential characteristics. The described examples are to be considered in all respects only as illustrative, not restrictive. The scope of the invention is, therefore, indicated by the appended claims, rather than by the foregoing description. All changes within the meaning and range of equivalency of the claims are to be embraced within their scope.

The invention claimed is:

1. A system for maintaining humidity, comprising:

a receptacle operable to hold liquid that contributes to ambient humidity upon evaporation;

a breathable housing sized for placement within a resonance chamber of a musical instrument;

tubing providing a channel for the liquid from the receptacle into the housing; and a storage structure, within the housing, operable to:
collect liquid flowing from the receptacle; and
store the liquid during evaporation, increasing humidity within the resonance chamber.

2. The system of claim 1, further comprising a fastener extending from the receptacle and operable to attach the receptacle to an instrument holder, at a location above the resonance chamber of the musical instrument supported by the instrument holder, so as to drip feed the liquid from the receptacle into the channel provided through the tubing into the housing for collection by the storage structure.

3. The system of claim 1, further comprising an overflow structure within the housing and below the storage structure, the overflow structure operable to collect a portion of the liquid overflowing the storage structure.

4. The system of claim 1, further comprising a flow regulator within the channel passing through the tubing and operable to control a flow rate of the liquid from the receptacle, through the tubing, into the housing, and collected by the storage structure.

5. The system of claim 4, further comprising a moisture detector disposed within the housing and below the storage structure, the moisture detector communicatively coupled to the flow regulator, at least one of, directly and indirectly by way of logic operable to provide control signals to the flow regulator, and operable to send a moisture measurement indicative of the liquid overflowing the storage structure to inform a determination of the flow rate controlled by the flow regulator.

6. The system of claim 4, wherein the flow regulator comprises a solenoid valve operable to block off a flow of the liquid through the tubing, when disposed in an engaged position, and to permit the flow when disposed in a disengaged position, the solenoid valve communicatively coupled to logic, which provides the solenoid valve with control signals to control the position of the solenoid valve.

7. The system of claim 4, further comprising:
a hygrometer sized for placement within the resonance chamber, with the housing, the hygrometer operable to make humidity measurements within the resonance chamber; and
logic communicatively coupled to the flow regulator and the hygrometer and operable to:
receive the humidity measurements from the hygrometer;
determine the flow rate through the tubing for the liquid collected by the storage structure to achieve at least one of a predetermined humidity, and a humidity within a predetermined range of humilities, within the resonance chamber based on the humidity measurements; and
control a position of the flow regulator to achieve the flow rate.

8. The system of claim 7, further comprising a wireless transceiver communicatively coupled to at least one of the logic and the hygrometer, the wireless transceiver operable to:
communicate remotely with a computing device; and
relay information to the computing device from at least one of the hygrometer and the logic.

9. A method for preserving local humidity levels, comprising:
holding an evaporative fluid in a fluid reservoir disposed outside a sound box of a musical instrument;
drip-feeding the evaporative fluid from the fluid reservoir outside the sound box to a fluid-retainer, within a sound-box insert disposed within the sound box, through a duct connecting the fluid reservoir to the sound-box insert;
collecting the evaporative fluid, drip-fed from the fluid reservoir, in the fluid-retainer within the sound-box insert; and
evaporating the evaporative fluid through at least one gap in the sound-box insert into a space within the sound box.

10. The method of claim 9, further comprising attaching the fluid reservoir to an upper region of a musical-instrument holder.

11. The method of claim 9, further comprising:
detecting evaporative fluid in an overflow region of the sound-box insert; and
restricting a flow of the evaporative fluid through the duct into the fluid-retainer.

12. The method of claim 9, further comprising:
collecting humidity level data in the sound box with a hygrometer; and
comparing, with hardware logic, the humidity level data to a value for an acceptable humidity level; and
calculating, with the hardware logic, a value for a control metric controlling a feed rate for the evaporative fluid passing through the duct into the fluid-retainer based on a difference between the humidity level data and the value for the acceptable humidity level.

13. The method of claim 12, further comprising adjusting, according to the value for the control metric, a control gate through which the evaporative fluid must pass to flow through the duct into the fluid-retainer.

14. The method of claim 12, further comprising:
transmitting the humidity level data to a wireless communication network;
making the humidity level data available to a computing device over the wireless communication network; and
receiving a command to adjust the control gate over the communication network.

15. A system for a humidifier;
a fluid tank operable to hold a supply of a fluid;
a capsule, with at least one air passageway therein, configured to be placed within a musical instrument;
a conduit, disposed between the fluid tank and the capsule, operable to deliver the fluid from the fluid tank into the capsule;
a fluid trap, disposed within the capsule, operable to retain the fluid, delivered from the fluid tank, through the conduit, and into the capsule, while the fluid evaporates; and
an adjustable valve, coupled with the conduit, operable to manage delivery of the fluid through the conduit and into the capsule.

16. The system of claim 15, wherein the musical instrument comprises a stringed instrument; and further comprising:
a forked support operable to receive a region of a neck of the stringed instrument while preventing a broader region of the stringed instrument, disposed above the region of the neck, from slipping through the forked support, to hold the musical instrument; and
a fluid-tank dock incorporated within the forked support, the fluid-tank dock operable to receive and hold the fluid tank.

17. The system of claim 15, further comprising:
at least one additional conduit; and
at least one additional capsule provided with an additional fluid trap disposed therein, the at least one additional conduit and the at least one additional capsule operable to be placed within at least one additional musical instrument.

18. The system of claim 15, further comprising a measurement device operable to:

be placed within the musical instrument;

measure ambient conditions within the musical instrument, the ambient conditions comprising ambient humidity within the musical instrument; and communicate a measurement of the ambient conditions, at least one of directly and indirectly, to the adjustable valve.

19. The system of claim 15, further comprising a moisture sensor operable to:

be coupled with the capsule;

sense a presence of the fluid outside the fluid trap;

indicate the presence of the fluid outside the fluid trap to the adjustable valve, at least one of directly and indirectly.

20. The system of claim 15 further comprising at least one of:

a measurement device operable to be placed within the musical instrument and to:

measure ambient conditions within the musical instrument;

communicate a measurement of ambient conditions, at least one of directly and indirectly, to the adjustable valve; and a moisture sensor coupled with the capsule and operable to:

detect a presence of the fluid outside the fluid trap;

indicate the presence of the fluid outside the fluid trap to the adjustable valve at least one of directly and indirectly; and, also further comprising management logic, communicatively coupled to the at least one of the measurement device and the moisture sensor, the management logic operable to:

receive at least one of the measurement and an indication of the presence; and convert at least one of the measurement and the indication of the presence to an adjustment signal communicated to the adjustable valve and adjusting a position of the adjustable valve, changing an amount of the fluid passing through the conduit into the capsule.

* * * * *